US006671924B1

(12) United States Patent
Rood

(10) Patent No.: US 6,671,924 B1
(45) Date of Patent: Jan. 6, 2004

(54) VACUUM DUSTPAN

(76) Inventor: Richard K. Rood, 309 W. Lake Mead Dr., Suite C, Henderson, NV (US) 89015-7056

( * ) Notice: Subject to any disclaimer, the term of this patent is extended or adjusted under 35 U.S.C. 154(b) by 0 days.

(21) Appl. No.: 10/013,376

(22) Filed: Dec. 11, 2001

Related U.S. Application Data

(60) Provisional application No. 60/254,803, filed on Dec. 12, 2000.

(51) Int. Cl.[7] ..... A47L 5/38
(52) U.S. Cl. ..... 15/310; 15/301; 15/331
(58) Field of Search ..... 15/301, 310, 331, 15/334

(56) References Cited

U.S. PATENT DOCUMENTS 548,721 A * 10/1895 Opdyke ..... 116/64
5,205,013 A * 4/1993 Lopes ..... 15/301
5,560,077 A * 10/1996 Crotchett ..... 15/339
5,829,090 A * 11/1998 Melito et al. ..... 15/352
5,953,788 A * 9/1999 Douglas ..... 15/339
6,286,177 B1 * 9/2001 Robinson ..... 15/301
6,292,977 B1 * 9/2001 Mantyla et al. ..... 15/310
6,317,920 B1 * 11/2001 Brickner et al. ..... 15/334

FOREIGN PATENT DOCUMENTS

GB 2361862 * 11/2001

* cited by examiner

*Primary Examiner*—Terrence R. Till
(74) *Attorney, Agent, or Firm*—Gregory J. Nelson

(57) ABSTRACT

A vacuum dustpan having a housing with an inlet to the level of the floor surface into which dust and debris can be directed. A vacuum motor induces a vacuum to transfer the debris to a collection chamber within the housing. The vacuum dustpan is usable in locations such as shops, hair salons, kitchens and other environments where debris collects and periodically swept.

6 Claims, 2 Drawing Sheets

VACUUM DUSTPAN

This application is based on provisional application Ser. No. 60/254,803, filed Dec. 12, 2000, entitled "Vacuum Dustpan."

FIELD OF THE INVENTION

The present invention relates to a vacuum device and more particularly relates to vacuum dustpan which will collect and pick up dust and debris which is swept into it.

BACKGROUND OF THE INVENTION

Many work areas such as hair salons, wood shops and assembly areas are periodically swept using a broom or vacuum cleaner. Locations such as these having hard floor surfaces collect hair, sawdust and other items that must be periodically collected by sweeping these materials into a dustpan. The dustpan is then emptied into a waste container. This operation requires a considerable amount of time and also considerable physical effort. The manual sweeping cleaning operation requires the individual to sweep the debris and dust into a pile or a number of piles and then using a collection device, such as a dustpan, to pick up the debris and transfer it to a waste container. Considerable bending occurs and it is easy for the individual to fail to collect all of the dust and debris that has been accumulated in the pile or piles leaving residual debris.

In order to make the collection of dust and debris on a hard surface is more efficient, various vacuum devices can be found in the prior art.

U.S. Pat. No. 5,408,721 shows an automatic dustpan apparatus for use with a central vacuum system whereby debris on the floor may be swept into the vicinity of the automatic dustpan and directed into the central vacuum cleaning system. A valve within the dustpan closes when the dustpan is not in use.

U.S. Pat. No. 5,560,077 shows a wheel housing which encapsulates a vacuum motor assembly. The housing interior forms vacuum ducting joining a vacuum chamber to nozzles on the underside of the housing. The nozzles extend peripherally and sufficient suction is generated that allows the device to collect dirt swept near it from any direction. During non-use, the device is parked in a charging nest.

There nevertheless exists the need a need for a simple, effective vacuum dustpan for locations such as hair salons, shops and the like.

BRIEF SUMMARY OF THE INVENTION

Briefly, the present invention provides a vacuum dustpan which reduces the effort involved to pick up dust and debris that has been swept into piles for collection in locations such as shops and hair salons. The device has a housing which contains a vacuum motor and a collection chamber. An inlet along the bottom edge of the container communicates with the collector and the vacuum motor will generate sufficient suction to transfer dust and debris swept near the inlet into the collection chamber. Preferably the inlet is provided with an apron or pan which will assist in directing debris into the inlet.

BRIEF DESCRIPTION OF THE DRAWINGS

Other features and advantages of the following invention will become more apparent from the following description taken in conjunction with the accompanying drawings in which.

DETAILED DESCRIPTION OF THE DRAWINGS

Figure 1:
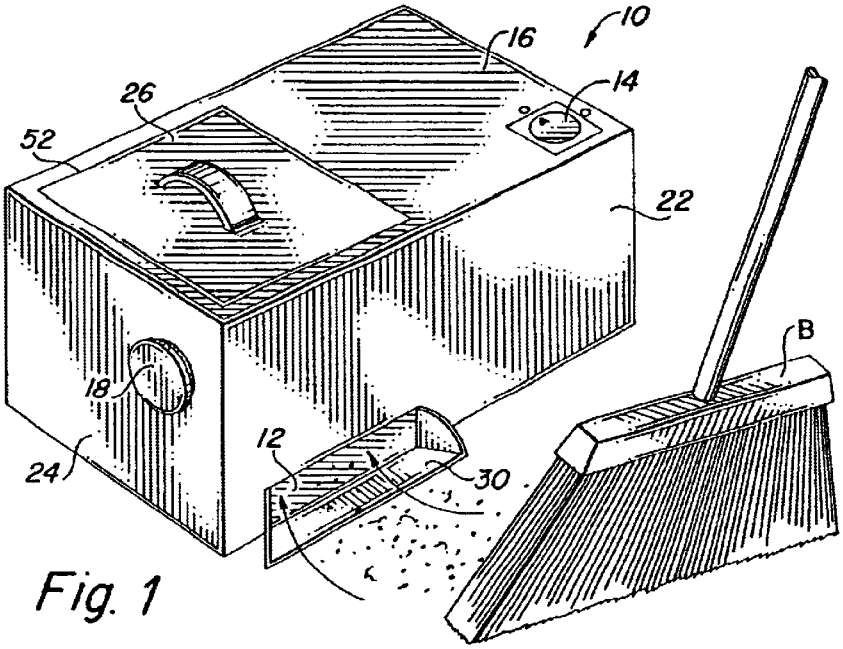
FIG. 1 is a perspective view of the vacuum device of the present invention shown in a use environment.

The present invention provides a vacuum dustpan 10 which may be located in any convenient location within a use-environment such as an out-of-way position in a hair salon. Periodically, employees of the hair salon will periodically sweep the area collecting hair, dust and debris that is accumulated throughout the day. The worker or employee will then direct the debris to toward the inlet of the device using a broom B as shown in FIG. 1. As the debris or hair is advanced towards the inlet 12 of the device 10 is actuated by means of switch 14 which will cause the debris and hair to be drawn into the inlet and collected within the housing 16 for later disposal.

Figure 4:
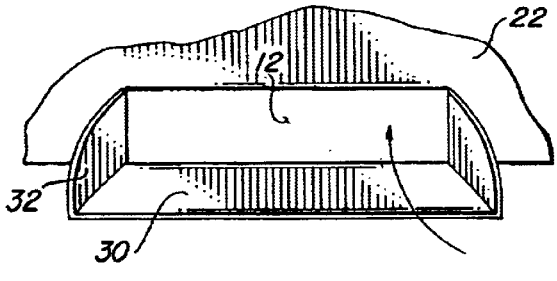
FIG. 4 shows the details of the inlet of the dustpan.

The vacuum dustpan 10 is shown having housing 16 which has opposite end walls 18, 20, front wall 22, rear wall 24, top 26. The housing is shown as being generally rectangular but may be any other suitable shape. The front wall 22 defines an inlet 12 which is shown as being generally rectangular located at the bottom edge of wall 22. As best seen in FIGS. 1 and 4, an apron 30 extends outwardly from the inlet having opposite side edges 32, 34 which will assist in directing debris into the inlet 12.

Figure 2:
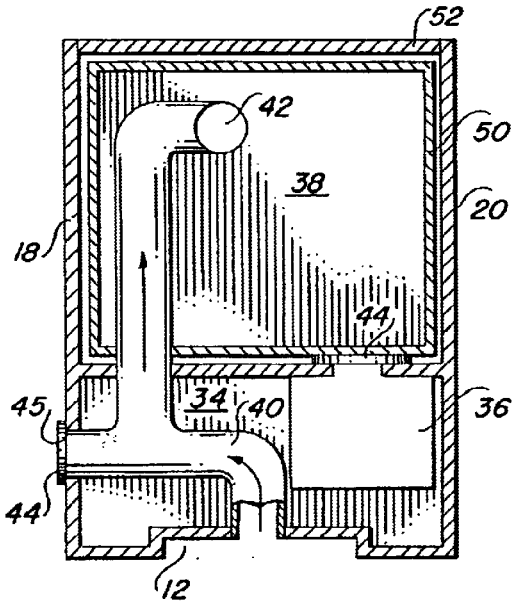
FIG. 2 is a cross-sectional view of the vacuum dustpan of the present invention.
Figure 3:
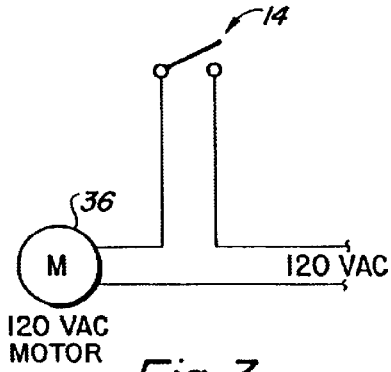
FIG. 3 is an electrical schematic.

As best seen in FIG. 2, the housing has a lower chamber 34 which contains a vacuum motor 36 which communicates with a collector chamber 38 to induce a vacuum in the chamber across a filter 44. The inlet communicates with the collector chamber via conduit 40 which discharges outlet 42 into the collector chamber. A hose inlet 44 may be provided extending at wall 18 which has a cap 45 which may be removed if the user wishes to connect an attachment or accessory such as a vacuum head having a flexible hose to the device.

The motor 36 is operated by means of switch 14. Preferably the switch 14 is located in a convenient location so that it may be operated by the foot of the user. As shown, the switch 12 is located on the top wall 26 of the housing.

The collection chamber 38 may be provided with either a removable liner 50 which can be periodically removed by removing cover 52 and replaced with a liner. Alternatively, the entire collector chamber 38 can be removable so that it can be carried to a trash receptacle, emptied and returned to a position within the housing.

From the foregoing, it will be appreciated that the device may be placed in a suitable convenient location in a shop, such as against a wall, where it is accessible but not to interfere with normal traffic patterns. The device may also be conveniently placed in a cabinet area below a kitchen sink with the inlet 12 extending through the baseboard. When it is required to pick up dust and debris, the operator will manually sweep the dust or debris towards the inlet using a broom or similar cleaning device. When the debris, such as hair in a hair salon, is advanced to a location near the inlet, the device is turned on by depressing the switch 12. This will actuate the vacuum motor causing a flow of air from the inlet into the collection chamber. Any dust, debris, hair or the like in the area of the inlet will be drawn into the inlet and deposited in the collector chamber for later disposal. The inclined and projecting apron surface of the pan or tray will assist the user in properly directing the debris into the housing.

Figure 5:
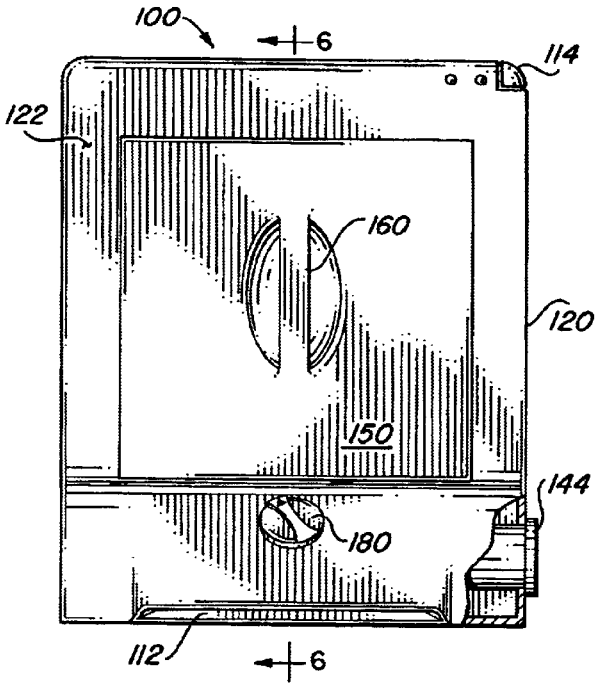
FIG. 5 is a front view of an alternate embodiment of the dustpan.
Figure 6:
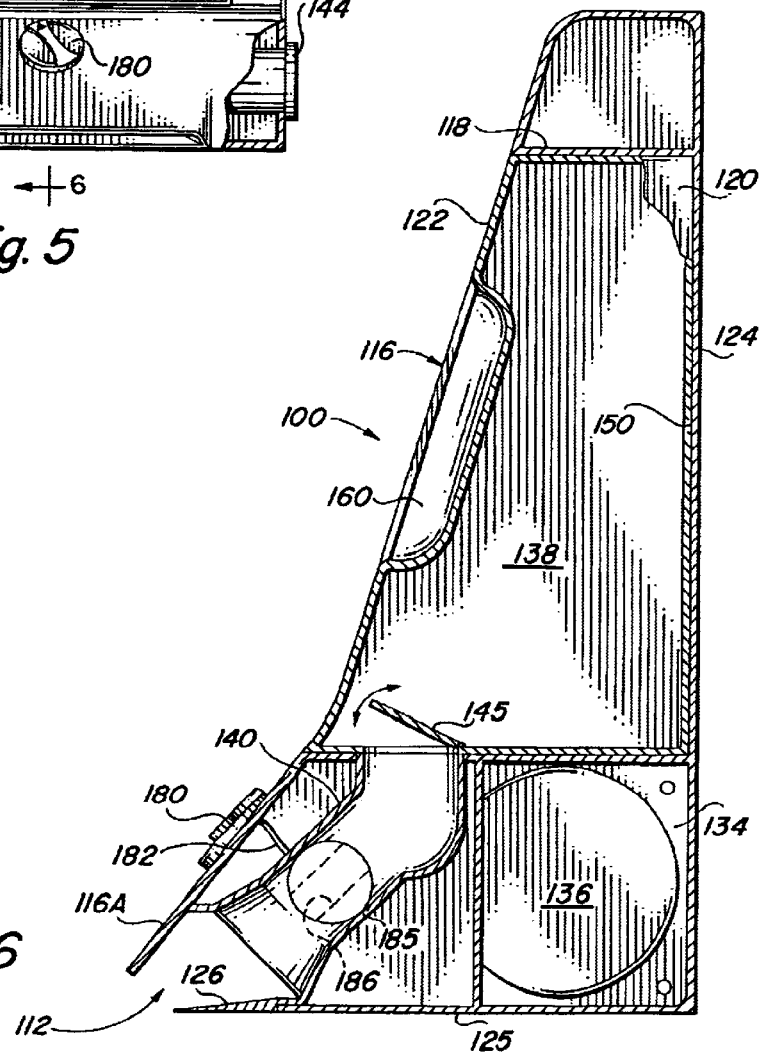
FIG. 6 is a cross-sectional view of the modified version of the dustpan of the present invention taken along line A—A of FIG. 5.

Referring to FIGS. 5 and 6, a modified version or embodiment is shown and designated by the numeral 100. The dustpan has a housing 116 with a generally vertical rear wall 124 and a downwardly forwardly sloping front wall 122, opposite sidewalls 120 and a floor 125. An inlet opening 112 is defined between the lower edge of front wall 116 and the front edge of the floor 125. The floor 125 is tapered at 126 to assist in directing dust and debris into the inlet 112 from which it is advanced through conduit 140 under the influence of a vacuum induced in the collection chamber 138 by vacuum motor 136. A flapper 145 opens when the motor is activated and closes to prevent debris from escaping from chamber 138. The motor 136 is located in the rear of the housing 116 below the collection chamber 138. A switch 114 is conveniently located on the upper part of the housing wall 116.

The collection chamber 138 is preferably a bin 150 removable from the housing and has a handle 160 to facilitate removal and replacement. The bin 150 has an open top so it may be emptied and replaced. When the bin is positioned in the housing, the upper open end is sealed by horizontal wall 118.

A vacuum hose may be attached to the inlet of conduit 144 at the side of the dustpan device. A selection switch 180 on the front may be used to direct the air flow from either the inlet 112 or inlet 144 on the sidewall 120. The selection switch is connected by a shaft 182 to a ball valve 185 having a diametral passage 186 which, when the ball is rotated by the selection switches will induce a vacuum in either conduit 140 or 144.

From the foregoing, it will be appreciated that the vacuum dustpan of the present invention provides an efficient means for collecting dust and debris that is periodically swept from a floor surface. The device is small, compact and may be easily positioned in a convenient location within the work environment.

It will be obvious to those skilled in the art to make various changes, alterations and modifications to the invention described herein. To the extent these various changes, alterations and modifications do not depart from the spirit and scope of the appended claims, they are intended to be encompassed therein.

I claim:

1. A vacuum dustpan for collecting debris from a floor surface comprising:

(a) a housing having a debris collection chamber and defining an inlet;

(b) a vacuum motor for generating a flow of air from said inlet to said collection chamber; and (c) said inlet including an apron extending outwardly from said inlet, said apron having an inclined surface to direct swept debris toward said inlet.

2. The dustpan of claim 1 wherein said motor is actuated by a foot operated switch.

3. The dustpan of claim 1 further including a vacuum hose fitting by-passing the inlet.

4. The dustpan of claim 3, including a selection switch for selectively directing air flow from the inlet on the vacuum hose fitting to the collection chamber.

5. The dustpan of claim 1 wherein said flow of air is via a conduit extending from the inlet to an opening in the collection chamber and further including a flapper at said opening.

6. The dustpan of claim 1 wherein said collection chamber comprises a removable bin.

* * * * *